US007353604B2

(12) United States Patent
Hirota et al.

(10) Patent No.: US 7,353,604 B2
(45) Date of Patent: Apr. 8, 2008

(54) METHOD FOR MANUFACTURING AN INKJET HEAD

(75) Inventors: Atsushi Hirota, Nagoya (JP); Shin Ishikura, Kokubo (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 387 days.

(21) Appl. No.: 11/055,771

(22) Filed: Feb. 11, 2005

(65) Prior Publication Data

US 2005/0179743 A1 Aug. 18, 2005

(30) Foreign Application Priority Data

Feb. 12, 2004 (JP) ..... 2004-034791
Feb. 12, 2004 (JP) ..... 2004-034792

(51) Int. Cl.
*B21D 53/76* (2006.01)
*B41J 2/05* (2006.01)

(52) U.S. Cl. ..... 29/890.1; 29/25.35; 29/830; 29/831; 29/832; 347/65

(58) Field of Classification Search ..... 29/890.1, 29/25.35, 830, 831, 832, 840, 843; 347/68–70, 347/41, 65, 74, 40; 430/312; 310/328, 330, 310/331

See application file for complete search history.

(56) References Cited

U.S. PATENT DOCUMENTS 3,850,717 A 11/1974 Keur et al.
4,604,633 A * 8/1986 Kimura et al. ..... 347/7
4,730,197 A * 3/1988 Raman et al. ..... 347/40
4,973,981 A 11/1990 Bartky et al.
5,466,985 A 11/1995 Suzuki
5,736,993 A * 4/1998 Regimbal et al. ..... 347/11
5,790,156 A * 8/1998 Mutton et al. ..... 347/71
5,821,953 A * 10/1998 Nakano et al. ..... 347/10
5,842,258 A 12/1998 Harvey et al.
6,356,008 B1 3/2002 Nakajima
2003/0122888 A1 7/2003 Baba et al.
2003/0150113 A1 8/2003 Ito et al.
2004/0008241 A1 1/2004 Junhua

FOREIGN PATENT DOCUMENTS

CN 1442302 A 9/2003
EP 0 376 606 A1 7/1990
EP 1 338 419 A1 8/2003
JP A 11-064175 3/1999

* cited by examiner

*Primary Examiner*—A. Dexter Tugbang
*Assistant Examiner*—Tai Van Nguyen
(74) *Attorney, Agent, or Firm*—Oliff & Berridge, PLC

(57) ABSTRACT

A method for manufacturing an inkjet head includes producing a flow path unit, producing an actuator unit, bonding the actuator unit with the flow path unit to produce a bonded structure; measuring a frequency characteristic of impedance of the piezoelectric structure of the bonded structure in each of regions facing at least one of the pressure chambers, and determining whether or not the bonded structure is a good product on a basis of at least one of a distribution of (Fa–Fr) in the plural regions where Fa represents antiresonance frequency of each region at which impedance of each region are maximal and Fr represents resonance frequency of each region at which impedance of each region is minimal, a distribution of Fr in the plural regions, and a distribution of Zr in the plural regions, where Zr represents impedance of each region at the resonance frequency of each region.

13 Claims, 10 Drawing Sheets

METHOD FOR MANUFACTURING AN INKJET HEAD

BACKGROUND OF THE INVENTION

1. Field of the Invention

The present invention relates to a method for manufacturing an inkjet head in an inkjet printer for ejecting ink to thereby perform printing, and an inkjet head manufactured in the same method.

2. Description of the Related Art

An inkjet printer has an inkjet head for ejecting ink onto a recording medium. There has been known an inkjet head including a plurality of pressure chambers supplied with ink, and a piezoelectric element corresponding to the pressure chambers, wherein voltage is applied to the piezoelectric elements so that the piezoelectric elements are driven to generate pressure in the pressure chambers and thereby eject ink from nozzles corresponding to the pressure chambers. Such an inkjet head is typically manufactured by bonding a flow-path member with a piezoelectric element. In the flow-path member, thin sheets of metal with openings formed therein are laminated to define pressure chambers and ink flow paths including nozzles internally. The piezoelectric element is put between electrodes. To eject ink from the nozzles, voltage is applied to the electrodes holding the piezoelectric element therebetween, through an electric power supply member such as an FPC (Flexible Printed Circuit) by a control unit.

The process for manufacturing the inkjet head includes a determining step of determining a failure in bonding between the flow-path member and the piezoelectric element. In the determining step, ink is ejected from the assembled inkjet head so as to determine a failure in those members. However, when the determining step is carried out after the inkjet head has been assembled, there is a problem that the cost of parts and the manufacturing cost must be caused even if the inkjet head is defective. Accordingly, there has been known a technique in which voltage is applied to electrodes through an FPC serving as an electric power supply member in a stage where the electric power supply member is connected to a piezoelectric element, so that the eigenfrequency of the piezoelectric element is measured, and a failure in bonding between the flow-path member and the piezoelectric element is determined based on the measuring result (see JP-A-Hei. 11-64175 (FIG. 5)). According to this technique, such a failure can be detected without ejecting ink, so that it is possible to save a useless cost of parts and a useless manufacturing cost.

SUMMARY OF THE INVENTION

In the aforementioned technique, a failure in bonding between respective members is determined by examining the mechanically constrained state of the piezoelectric element based on its eigenfrequency. However, the piezoelectric characteristic of the piezoelectric element cannot be grasped well only by the eigenfrequency. It is therefore impossible to detect an abnormality in the piezoelectric characteristic with high accuracy. Accordingly, when there is an abnormality in the piezoelectric characteristic of the piezoelectric element, the abnormality cannot be detected without ejecting ink from an inkjet head, which has been assembled. It is therefore necessary to cause a useless cost of parts and a useless manufacturing cost for a defective inkjet head.

The invention provides a method for manufacturing an inkjet head, in which it is possible to save a useless cost of parts and a useless manufacturing cost, and an inkjet head manufactured in the same method.

According to one embodiment of the invention, a method for manufacturing an inkjet head, includes producing a flow path unit that comprises a plurality of individual ink flow paths passing through pressure chambers and reaching nozzles for ejecting ink, respectively; producing an actuator unit that comprises a piezoelectric structure; bonding the actuator unit with the flow path unit to produce a bonded structure of the flow path unit and the actuator unit; measuring a frequency characteristic of impedance of the piezoelectric structure of the bonded structure in each of regions facing at least one of the pressure chambers; and determining whether or not the bonded structure is a good product on a basis of at least one of (a) a distribution of (Fa−Fr) in the plural regions where Fa represents antiresonance frequency of each region at which impedance of each region are maximal and Fr represents resonance frequency of each region at which impedance of each region is minimal; (b) a distribution of Fr in the plural regions; and (c) a distribution of Zr in the plural regions, where Zr represents impedance of each region at the resonance frequency of each region.

The inventors of the invention newly discovered that the distribution of the differences Fa−Fr, Fa, and Zr had a correlation with the piezoelectric characteristic of the piezoelectric element. The invention was developed based on this new knowledge of the inventors. By checking the Fa−Fr distribution, the Fr distribution, and/or the Zr distribution, it is possible to determine whether an abnormal distribution is included or not. That is, even if an abnormality is included partially in the distribution, the abnormality can be detected easily so that a failure in the piezoelectric element can be determined with high accuracy. It is therefore possible to save a useless cost of parts and a useless manufacturing cost.

DETAILED DESCRIPTION OF THE PREFERRED EMBODIMENTS

A preferred embodiment of the invention will be described below with reference to the drawings.

<Overall Structure of Head>

Figure 1:
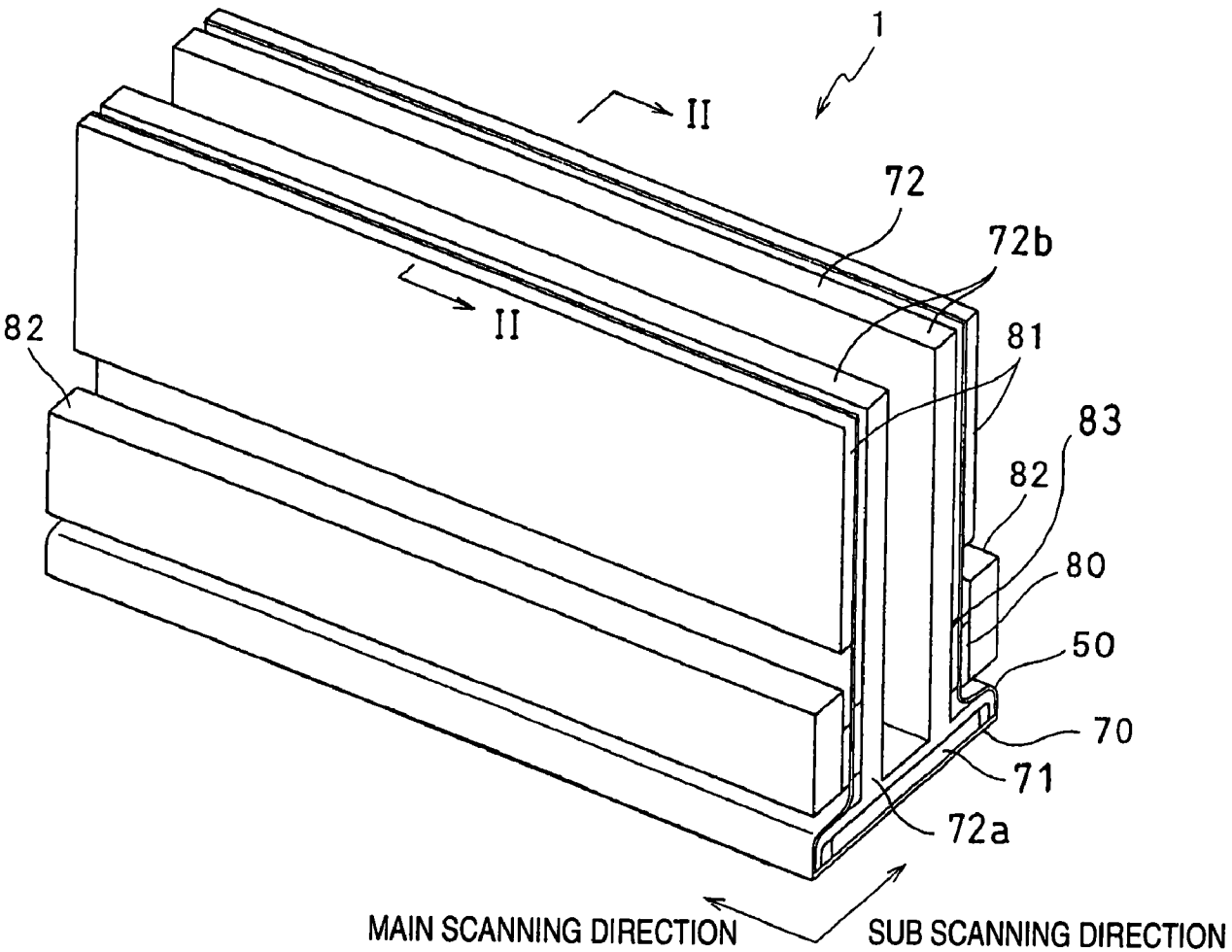
FIG. 1 is an outside perspective view of an inkjet head manufactured according to an embodiment of the invention.
Figure 2:
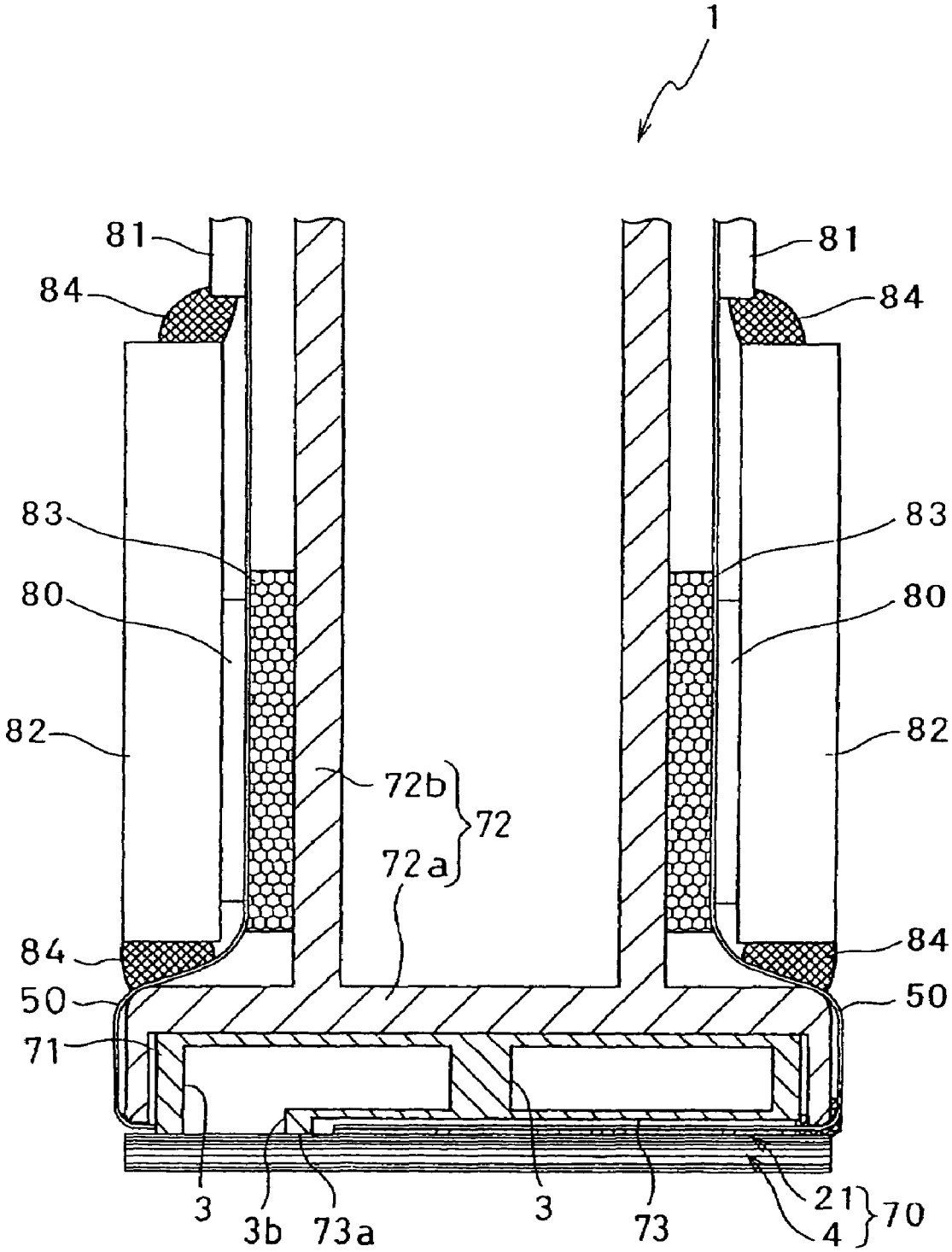
FIG. 2 is a sectional view of the inkjet head shown in FIG. 1.

Description will be made about an inkjet head manufactured in a manufacturing method according to an embodiment of the invention. FIG. 1 is a perspective view of an inkjet head 1 according to this embodiment. FIG. 2 is a sectional view taken on line II-II in FIG. 1. The inkjet head 1 has a head body 70 for ejecting ink onto a paper, and a base block 71 disposed above the head body 70. The head body 70 has a rectangular planar shape extending in a main scanning direction. The base block 71 is a reservoir unit in which two ink reservoirs 3 are formed. The ink reservoirs 3 serve as ink flow paths through which ink is supplied to the head body 70.

The head body 70 includes a flow path unit 4 in which ink flow paths are formed, and a plurality of actuator units 21 bonded to the upper surface of the flow path unit 4 by an epoxy-based thermosetting adhesive agent. The flow path unit 4 and the actuator units 21 have a configuration in which a plurality of thin sheets are laminated and bonded to one another. In addition, a flexible printed circuit (FPC) 50 serving as an electric power supply member is bonded to the upper surface of each actuator unit 21 by solder, and extracted to left or right.

Figure 3:
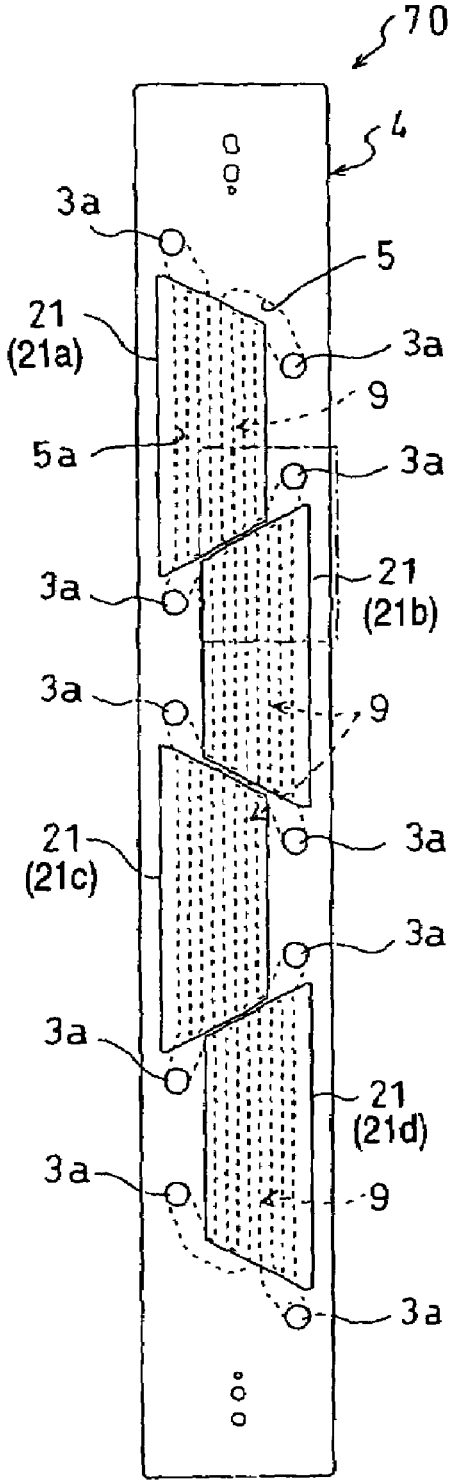
FIG. 3 is a plan view of a head body included in the inkjet head shown in FIG. 1.

FIG. 3 is a plan view of the head body 70. As shown in FIG. 3, the flow path unit 4 has a rectangular planar shape extending in one direction (main scanning direction). In FIG. 3, a manifold flow path 5 provided in the flow path unit 4 and serving as a common ink chamber is depicted by the broken line. Ink is supplied from the ink reservoirs 3 of the base block 71 to the manifold flow path 5 through a plurality of openings 3*a*. The manifold flow path 5 branches into a plurality of sub-manifold flow paths 5*a* extending in parallel to the longitudinal direction of the flow path unit 4.

Four actuator units 21 each having a trapezoidal planar shape are bonded to the upper surface of the flow path unit 4. The actuator units 21 are arrayed zigzag in two lines so as to avoid the openings 3*a*. Each actuator unit 21 is disposed so that its parallel opposite sides (upper and lower sides) extend in the longitudinal direction of the flow path unit 4. Oblique sides of adjacent ones of the actuator units 21 overlap each other partially in the width direction of the flow path unit 4.

The lower surface of the flow path unit 4 opposite to the bonded region of each actuator unit 21 serves as an ink ejection region where a large number of nozzles 8 (see FIG. 5) are arrayed in a matrix. Pressure chamber groups 9 are formed in the surface of the flow path unit 4 opposite to the actuator units 21. Each pressure chamber group 9 has a large number of pressure chambers 10 (see FIG. 5) arrayed in a matrix. In other words, each actuator unit 21 has dimensions ranging over a large number of pressure chambers 10.

Returning to FIG. 2, the base block 71 is made of a metal material such as stainless steel. Each ink reservoir 3 in the base block 71 is a substantially rectangular parallelepiped hollow region extending in the longitudinal direction of the base block 71. The ink reservoir 3 communicates with an ink tank (not shown) through an opening (not shown) defined at its one end, so as to be always filled with ink. The ink reservoir 3 is provided with two pairs of openings 3*b* arranged in the extending direction of the ink reservoir 3. The openings 3*b* are disposed zigzag so as to be connected to the openings 3*a* in the regions where the actuator units 21 are not provided.

A lower surface 73 of the base block 71 projects downward near the openings 3*b* in comparison with their circumferences. The base block 71 abuts against the flow path unit 4 only in portions 73*a* provided near the openings 3*b* in the lower surface 73. Thus, any region of the lower surface 73 of the base block 71 other than the portions 73*a* provided near the openings 3*b* is separated from the head body 70, and the actuator units 21 are disposed in these separated regions.

The base block 71 is fixedly bonded into a recess portion defined in the lower surface of a grip 72*a* of a holder 72. The holder 72 includes the grip 72*a* and a pair of flat plate-like projecting portions 72*b* extending from the upper surface of the grip 72*a* in a direction perpendicular to the upper surface. The projecting portions 72*a* has a predetermined interval therebetween. Each FPC 50 bonded to the corresponding actuator unit 21 is disposed to follow the surface of the corresponding projecting portion 72*b* of the holder 72 through an elastic member 83 of sponge or the like. A driver IC 80 is disposed on the FPC 50 disposed on the surface of the projecting portion 72*b* of the holder 72. The FPC 50 is electrically connected to the driver IC 80 and the actuator unit 21 of the head body 70 by soldering so that a driving signal output from the driver IC 80 can be transmitted to the actuator unit 21.

A substantially rectangular parallelepiped heat sink 82 is disposed in close contact with the outside surface of the driver IC 80 so that heat generated in the driver IC 80 can be radiated efficiently. A board 81 is disposed above the driver IC 80 and the heat sink 82 and outside the FPC 50. Seal members 84 are put between the upper surface of the heat sink 82 and the board 81 and between the lower surface of the heat sink 82 and the FPC 50 respectively so as to bond them with each other.

Figure 4:
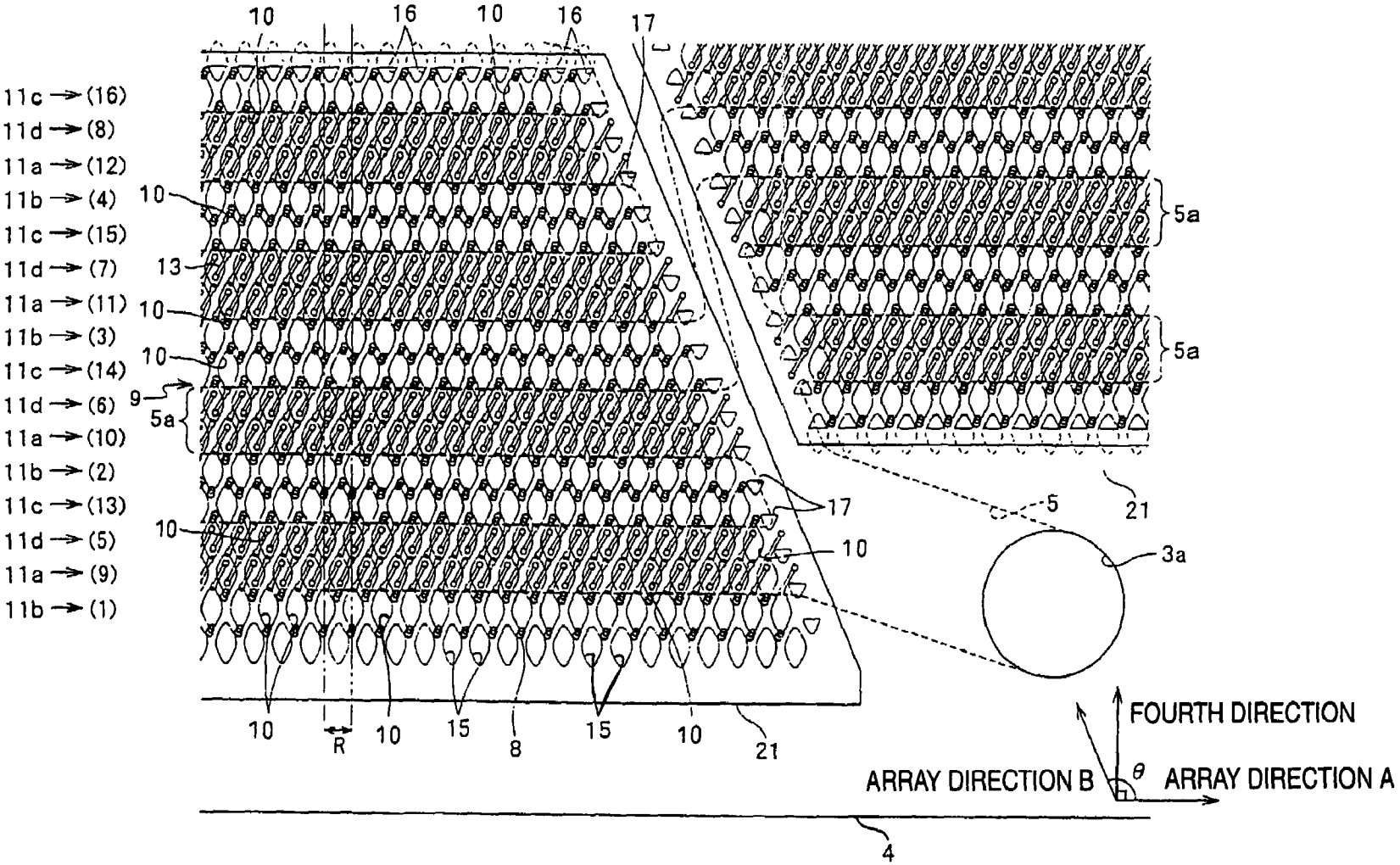
FIG. 4 is an enlarged view of a region surrounded by the one-dot chain line in FIG. 3.
Figure 5:
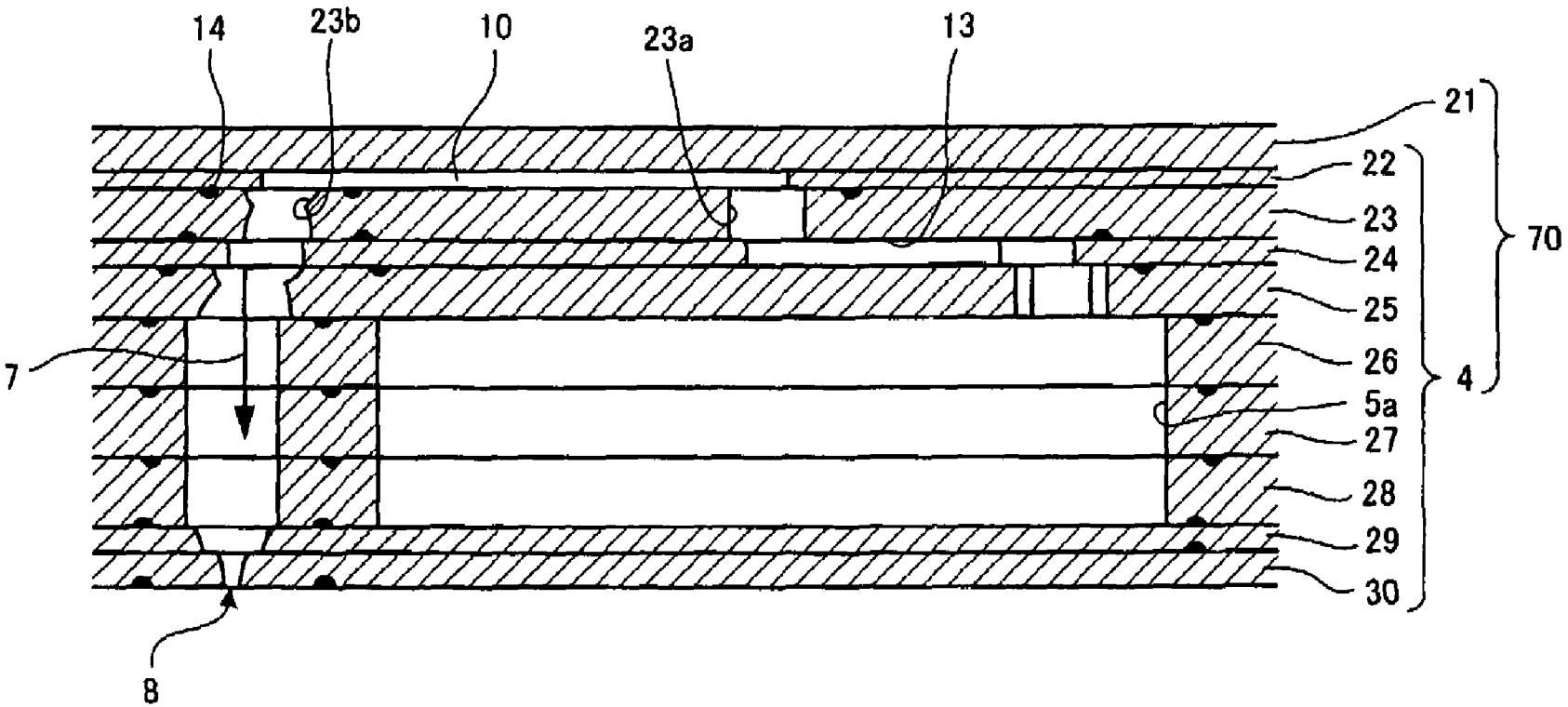
FIG. 5 is a partial sectional view corresponding to a pressure chamber of the head body shown in FIG. 3.

FIG. 4 is an enlarged view of the region surrounded with the one-dot chain line in FIG. 3. As shown in FIG. 4, in the flow path unit 4 facing the actuator units 21, four sub-manifold flow paths 5*a* extend in parallel to the longitudinal direction of the flow path unit 4. A large number of individual ink flow paths are connected to each sub-manifold flow path 5*a* so as to extend from the outlet thereof to the corresponding nozzle 8. FIG. 5 is a sectional view showing an individual ink flow path. As is understood from FIG. 5, each nozzle 8 communicates with the corresponding sub-manifold flow path 5*a* through a pressure chamber 10 and an aperture, that is, diaphragm 13. In such a manner, in the head body 70, an individual ink flow path 7 is formed for each pressure chamber 10 so as to extend from the outlet of the sub-manifold flow path 5*a* to the nozzle 8 through the aperture 13 and the pressure chamber 10.

<Head Sectional Structure>

As is understood from FIG. 5, the head body 70 has a laminated structure in which a total of 10 sheet members of the actuator units 21, a cavity plate 22, a base plate 23, an aperture plate 24, a supply plate 25, manifold plates 26, 27 and 28, a cover plate 29 and a nozzle plate 30 are laminated in a descending order from the top. Of those sheet members, the nine plates excluding the plate of the actuator units 21 constitute the flow path unit 4.

In each actuator unit 21, four piezoelectric sheets 41-44 (see FIG. 7) are laminated, and electrodes are disposed, as will be described in detail later. Of the piezoelectric sheets 41-44, only the uppermost layer 41 is set as a layer (hereinafter referred to as "layer having active portions" simply) having portions serving as active portions when an electric field is applied thereto. The other three layers 42-44 are set as inactive layers having no active portion. The cavity plate 22 is a metal plate in which a large number of substantially rhombic holes for forming spaces of the pressure chambers 10 are defined within the range where the actuator unit 21 is pasted. The base plate 23 is a metal plate in which a communication hole 23*a* between the pressure chamber 10 and the aperture 13 and a communication hole 23*b* between the pressure chamber 10 and the nozzle 8 are provided for each pressure chamber 10 of the cavity plate 22.

The aperture plate 24 is a metal plate in which a communication hole between the pressure chamber 10 and the corresponding nozzle 8 is provided for each pressure chamber 10 of the cavity plate for each pressure chamber 10 of the cavity plate 22, in addition to a hole serving as the aperture 13. The supply plate 25 is a metal plate in which a communication hole between the aperture 13 and the sub-manifold flow path 5*a* and a communication hole between the pressure chamber 10 and the corresponding nozzle 8 are provided. Each of the manifold plates 26, 27 and 28 is a metal plate in which a communication hole between the pressure chamber 10 and the corresponding nozzle 8 is provided for each pressure chamber 10 of the cavity plate 22, in addition to the sub-manifold flow path 5*a*. The cover plate 29 is a metal plate in which a communication hole between the pressure chamber 10 and the corresponding nozzle 8 is provided for each pressure chamber 10 of the cavity plate 22. The nozzle plate 30 is a metal plate in which a nozzle 8 is provided for each pressure chamber 10 of the cavity plate 22.

The ten sheets 21 to 30 are aligned and laminated to one another so that individual ink flow paths 7 are formed as shown in FIG. 5. Each individual ink flow path 7 first leaves upward from the sub-manifold flow path 5*a* and extends horizontally in the aperture 13. Then, the individual ink flow path 7 goes upward again and extends horizontally in the pressure chamber 10 again. After that, the individual ink flow path 7 turns obliquely downward so as to leave the aperture 13 for a while, and then turns vertically downward so as to approach the nozzle 8.

As is apparent from FIG. 5, the pressure chambers 10 and the apertures 13 are provided on different levels in the laminated direction of the respective plates. Consequently, in the flow path unit 4 facing the actuator units 21, as shown in FIG. 4, the aperture 13 communicating with one pressure chamber 10 can be disposed at the same position as another pressure chamber 10 adjacent to the one pressure chamber 10 in plan view. As a result, the pressure chambers 10 are brought into close contact with one another and arrayed with high density. Thus, high-resolution image printing can be attained by the inkjet head 1 occupying a comparatively small area.

Escape grooves 14 for letting a surplus adhesive agent out are provided in the upper and lower surfaces of the base plate 23 and the manifold plate 28, the upper surfaces of the supply plate 25 and the manifold plates 26 and 27 and the lower surface of the cover plate 29 so as to surround the openings defined in the bonded surfaces of the respective plates. Due to the existence of the escape grooves 14, the adhesive agent for bonding the plates with one another is prevented from reaching the individual ink flow paths. As a result, it is prevented to fluctuate their flow path resistances.

<Details of Flow Path Unit>

Refer to FIG. 4 again. A pressure chamber group 9 having a large number of pressure chambers 10 is formed within a range where each actuator unit 21 is attached. The pressure chamber group 9 has a trapezoidal shape substantially as large as the range where the actuator unit 21 is attached. Such a pressure chamber group 9 is formed for each actuator unit 21.

As is apparent from FIG. 4, each pressure chamber 10 belonging to the pressure chamber group 9 communicates with its corresponding nozzle 8 at one end of its long diagonal, and communicates with the sub-manifold flow path 5*a* through the aperture 13 at the other end of the long diagonal. As will be described later, individual electrodes 35 (see FIGS. 6 and 7) are arrayed in a matrix on the actuator unit 21 so as to face the pressure chambers 10 through the actuator unit 21, respectively. Each individual electrode 35 has a substantially rhombic shape in plan view and is one size smaller than the pressure chamber 10. Incidentally, in FIG. 4, the nozzles 8, the pressure chambers 10, the apertures 13, and the like, which are in the flow path unit 4 and should be depicted by broken lines, are depicted by solid lines in order to make the drawing understood easily.

The pressure chambers 10 are disposed contiguously in a matrix in two directions, that is, an array direction A (first direction) and an array direction B (second direction). The array direction A is the longitudinal direction of the inkjet head 1, that is, the direction in which the flow path unit 4 extends. The array direction A is parallel to the short diagonal of each pressure chamber 10. The array direction B is a direction of one oblique side of each pressure chamber 10, which is at an obtuse angle θ with the array direction A. The two acute angle portions of each pressure chamber 10 are located between two different pressure chambers 10 adjacent thereto.

The pressure chambers 10 disposed contiguously in a matrix in the two directions, that is, the array direction A and the array direction B, are separated at an equal distance corresponding to 37.5 dpi from each other in the array direction A. In each actuator unit 21, sixteen pressure chambers 10 are arranged in the array direction B.

The large number of pressure chambers 10, which are disposed in a matrix, form a plurality of pressure chamber rows in parallel to the array direction A shown in FIG. 4. The pressure chamber rows are divided into a first pressure chamber row 11*a*, a second pressure chamber row 11*b*, a third pressure chamber row 11*c* and a fourth pressure chamber row 11*d* in accordance with their relative positions to the sub-manifold flow path 5*a* when viewed from a direction (third direction) perpendicular to the paper of FIG. 4. Four sets of the first to fourth pressure chamber rows 11*a*-11*d* are disposed periodically in order of 11*c*, 11*d*, 11*a*, 11*b*, 11*c*, 11*d*, . . . , 11*b* from the upper side of the actuator unit 21 toward the lower side thereof.

In the pressure chambers 10*a* forming the first pressure chamber row 11*a* and the pressure chambers 10*b* forming the second pressure chamber row 11*b*, the nozzles 8 are unevenly distributed on the lower side of the paper of FIG. 4 with respect to a direction (fourth direction) perpendicular to the array direction A when viewed from the third direction. Each nozzle 8 is opposite to the vicinity of the lower end portion of the corresponding pressure chamber 10. On the other hand, in the pressure chambers 10*c* forming the third pressure chamber row 11*c* and the pressure chambers 10*d* forming the fourth pressure chamber row 11*d*, the nozzles 8 are unevenly distributed on the upper side of the paper of FIG. 4 with respect to the fourth direction. Each nozzle 8 is opposite to the vicinity of the upper end portion of the corresponding pressure chamber 10. In each of the first and fourth pressure chamber rows 11*a* and 11*d*, at least half the region of each pressure chamber 10*a*, 10*d* overlaps the sub-manifold flow path 5*a* when viewed from the third direction. In each of the second and third pressure chamber rows 11*b* and 11*c*, almost all the region of each pressure chamber 10*b*, 10*c* does not overlap the sub-manifold flow path 5*a* when viewed from the third direction. Accordingly, in any pressure chamber 10 belonging to any pressure chamber row, the width of the sub-manifold flow path 5*a* can be expanded as widely as possible and widely enough to supply ink to each pressure chamber 10 smoothly while the nozzle 8 communicating with the pressure chamber 10 is prevented from overlapping the sub-manifold flow path 5*a*.

As shown in FIG. 4, a large number of circumferential spaces 15 each having the same shape and the same size as each pressure chamber 10 are arrayed in a straight line all over the long side of the paired parallel sides of the trapezoidal pressure chamber group 9. The circumferential spaces 15 are defined by the actuator unit 21 and the base plate 23 closing holes formed in the cavity plate 22 and each having the same shape and the same size as each pressure chamber 10. That is, no ink flow path is connected to any circumferential space 15, and no individual electrode 35 to be opposed is provided in any circumferential space 15. That is, there is no case that any circumferential space 15 is filled with ink.

On the other hand, a large number of circumferential spaces 16 are arrayed in a straight line all over the short side of the paired parallel sides of the trapezoidal pressure chamber group 9. Further, in the head body 70, a large number of circumferential spaces 17 are arrayed in a straight line all over each oblique side of the trapezoidal pressure chamber group 9. Each of the circumferential spaces 16 and 17 penetrates the cavity plate 22 in a region of an equilateral triangle in plan view. No ink flow path is connected to any circumferential space 16, 17, and no individual electrode 35 to be opposed is provided in any circumferential space 16, 17. That is, in the same manner as the circumferential spaces 15, there is no case that any circumferential space 16, 17 is filled with ink.

<Details of Actuator Unit>

Next, description will be made about the configuration of each actuator unit 21. A large number of individual electrodes 35 are disposed in a matrix on the actuator unit 21 so as to have the same pattern as the pressure chambers 10. Each individual electrode 35 is disposed at a position where the individual electrode 35 faces the corresponding pressure chamber 10 in plan view.

Figure 6:
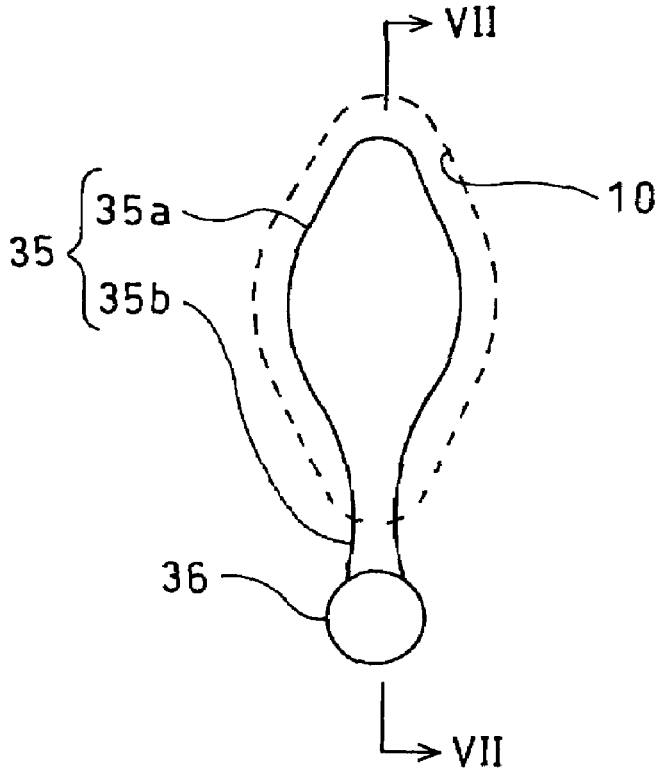
FIG. 6 is a plan view of an individual electrode formed on an actuator unit depicted in FIG. 3.

FIG. 6 is a plan view of an individual electrode 35. As shown in FIG. 6, the individual electrode 35 is constituted by a primary electrode region 35*a* and a secondary electrode region 35*b*. The primary electrode region 35*a* is disposed at a position where the primary electrode region 35*a* faces the pressure chamber 10 through the actuator unit 21, so that the primary electrode region 35*a* is located within the pressure chamber 10 in plan view. The secondary electrode region 35*b* is connected to the primary electrode region 35*a* and disposed to face the outside of the pressure chamber 10.

Figure 7:
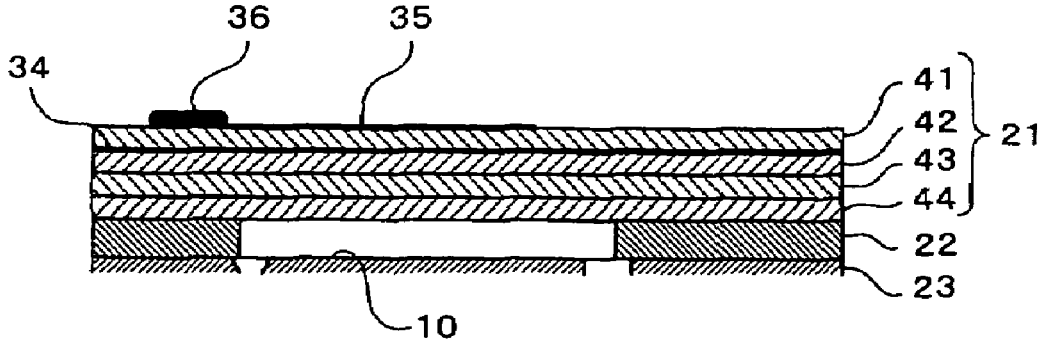
FIG. 7 is a partial sectional view of the actuator unit depicted in FIG. 3.

FIG. 7 is a sectional view taken on line VII-VII in FIG. 6. As shown in FIG. 7, the actuator unit 21 includes the four piezoelectric sheets 41, 42, 43 and 44 having an equal thickness of about 15 μm. The piezoelectric sheets 41-44 are formed as continuous lamellar flat plates (continuous flat plate layers) to be disposed over a large number of pressure chambers 10 formed within one ink ejection region in the head body 70. When the piezoelectric sheets 41-44 are disposed as continuous flat plate layers over a large number of pressure chambers 10, the individual electrodes 35 can be disposed on the piezoelectric sheet 41 with high density, for example, by use of a screen printing technique. Accordingly, the pressure chambers 10 to be formed at positions corresponding to the individual electrodes 35 can be also disposed with high density. Thus, high-resolution images can be printed. The piezoelectric sheets 41-44 are made of a lead zirconate titanate (PZT) based ceramics material having ferroelectricity.

The primary electrode region 35*a* of each individual electrode 35 formed on the piezoelectric sheet 41, which is the uppermost layer, has a substantially rhombic planar shape, which is substantially similar to the pressure chamber 10, as shown in FIG. 6. A lower acute angle portion in the substantially rhombic primary electrode region 35*a* is extended so as to connect with the secondary electrode region 35*b* facing the outside of the pressure chamber 10. A circular land portion 36 electrically connected to the individual electrode 35 is provided on the tip of the secondary electrode region 35*b*. As shown in FIG. 7, the land portion 36 faces a region of the cavity plate 22 where no pressure chamber 10 is formed. The land portion 36 is, for example, made of gold containing glass frit. The land portion 36 is bonded onto the surface of an extended portion of the secondary electrode portion 35*b* as shown in FIG. 6. Although the FPC 50 is not shown in FIG. 7, the land portion 36 is electrically connected to a contact point provided in the FPC 50. To establish this connection, it is necessary to press the contact point of the FPC 50 against the land portion 36. Since no pressure chamber 10 is formed in the region of the cavity plate 22 facing the land portion 36, the connection can be achieved surely by sufficient pressure.

A common electrode 34 having the same contour as the piezoelectric sheet 41 and having a thickness of about 2 μm is put between the piezoelectric sheet 41, which is the uppermost layer, and the piezoelectric sheet 42, which is under the piezoelectric sheet 41. The individual electrodes 35 and the common electrode 34 are made of a metal material such as Ag—Pd based metal material.

The common electrode 34 is grounded in a not-shown region. Consequently, the common electrode 34 is kept at constant potential or the ground potential in this embodiment equally over all the regions corresponding to all the pressure chambers 10. In addition, the individual electrodes 35 are connected to a driver IC 80 through the land portions 36 and the FPC 50 including a plurality of lead wires, which are independent of one another for each of the individual electrodes 35. Thus, the potential of each individual electrode 35 can be controlled correspondingly to each pressure chamber 10.

<Method for Driving Actuator Unit>

Next, description will be made about a method for driving each actuator unit 21. The piezoelectric sheet 41 in the actuator unit 21 has a polarizing direction in the thickness direction thereof. That is, the actuator unit 21 has a so-called unimorph type configuration in which one piezoelectric sheet 41 on the upper side (that is, distant from the pressure chambers 10) is set as a layer where active portions exist, while three piezoelectric sheets 42-44 on the lower side (that is, close to the pressure chambers 10) are set as inactive layers. Accordingly, when the individual electrodes 35 are set at positive or negative predetermined potential, each electric-field-applied portion between electrodes in the piezoelectric sheet 41 will act as an active portion so as to contract in a direction perpendicular to the polarizing direction due to piezoelectric transversal effect, for example, if an electric field is applied in the same direction as the polarization.

In this embodiment, a portion between each primary electrode region 35*a* and the common electrode 34 in the piezoelectric sheet 41 acts as an active portion which will generate a strain due to piezoelectric effect when an electric field is applied thereto. On the other hand, no electric field is applied from the outside to the three piezoelectric sheets 42-44 under the piezoelectric sheet 41. Therefore, the three piezoelectric sheets 42-44 hardly serve as active portions. As a result, mainly the portion between each primary electrode region 35*a* and the common electrode 34 in the piezoelectric sheet 41 contracts in a direction perpendicular to the polarizing direction due to piezoelectric transversal effect.

On the other hand, since the piezoelectric sheets 42-44 are not affected by any electric field, they are not displaced voluntarily. Therefore, between the piezoelectric sheet 41 on the upper side and the piezoelectric sheets 42-44 on the lower side, there occurs a difference in strain in a direction perpendicular to the polarizing direction, so that the piezoelectric sheets 41-44 as a whole intend to be deformed to be convex on the inactive side (unimorph deformation). In this event, as shown in FIG. 7, the lower surface of the actuator unit 21 constituted by the piezoelectric sheets 41-44 is fixed to the upper surface of the diaphragm (cavity plate) 22 which defines the pressure chambers. Consequently, the piezoelectric sheets 41-44 are deformed to be convex on the pressure chamber side. Accordingly, the volume of each pressure chamber 10 is reduced so that the pressure of ink increases. Thus, the ink is ejected from the corresponding nozzle 8. After that, when the individual electrodes 35 are restored to the same potential as the common electrode 34, the piezoelectric sheets 41-44 are restored to their initial shapes so that the volume of each pressure chamber 10 is restored to its initial volume. Thus, the pressure chamber 10 sucks ink from the sub-manifold flow path 5*a*.

According to another driving method, each individual electrode 35 may be set at potential different from the potential of the common electrode 34 in advance. In this method, the individual electrode 35 is once set at the same potential as the common electrode 34 whenever there is an ejection request. After that, the individual electrode 35 is set at potential different from the potential of the common electrode 34 again at predetermined timing. In this case, the piezoelectric sheets 41-44 are restored to their initial shapes at the timing when the individual electrode 35 has the same potential as that of the common electrode 34. Thus, the volume of the pressure chamber 10 increases in comparison with its initial volume (in the state where the individual electrode 35 and the common electrode 34 are different in potential), so that ink is sucked into the pressure chamber 10 through the sub-manifold flow path 5*a*. After that, the piezoelectric sheets 41-44 are deformed to be convex on the pressure chamber 10 side at the timing when the individual electrode 35 is set at different potential from that of the common electrode 34. Due to reduction in volume of the pressure chamber 10, the pressure on ink increases so that the ink is ejected.

<Method for Manufacturing Inkjet Head>

Figure 8:
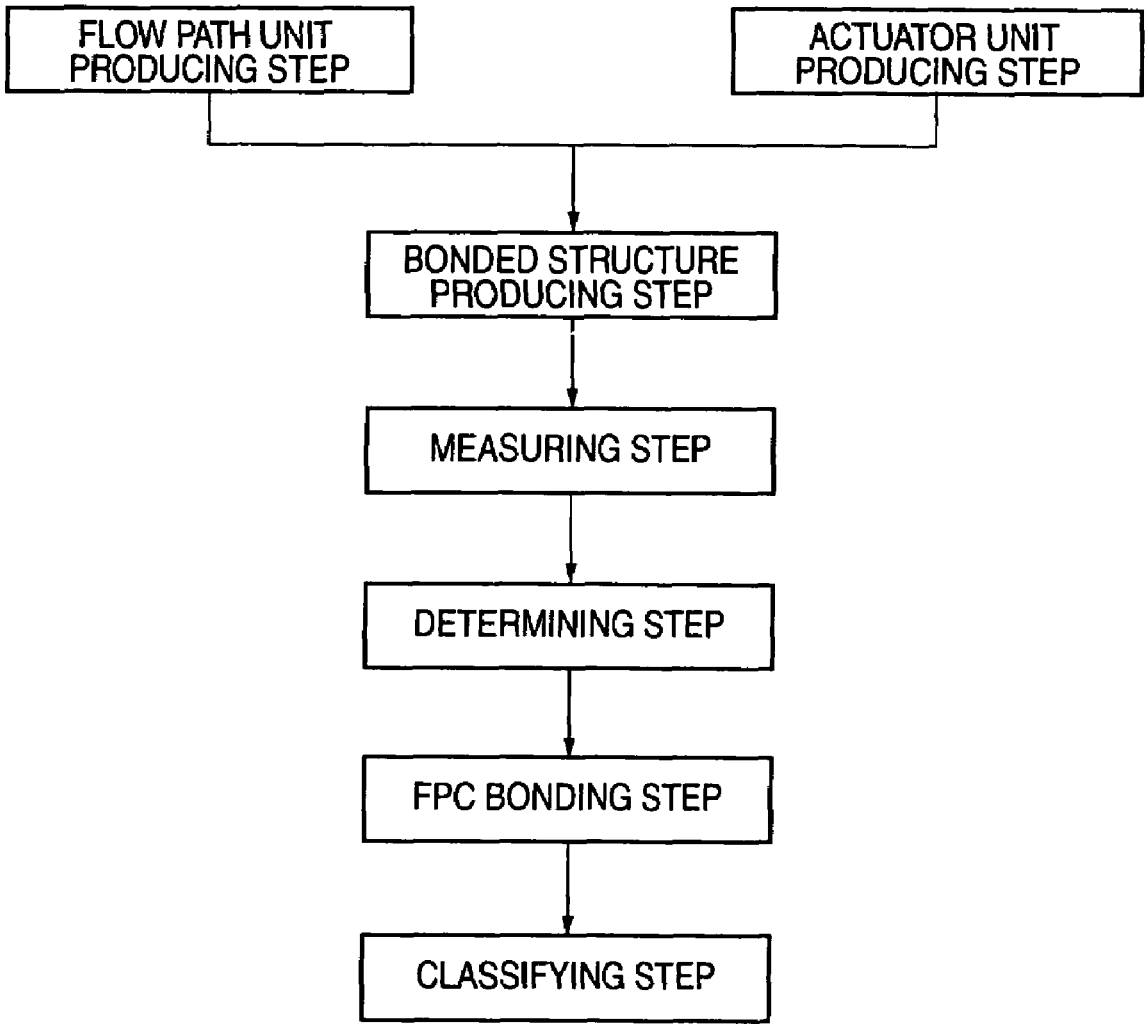
FIG. 8 is a block diagram showing a method for manufacturing the inkjet head shown in FIG. 1.

Next, a method for manufacturing the inkjet head 1 will be described with reference to FIG. 8. FIG. 8 is a block diagram showing a method for manufacturing the inkjet head 1. As shown in FIG. 8, the method for manufacturing the inkjet head 1 includes a flow path unit producing step, an actuator unit producing step, a head body (bonded structure) producing step, a measuring step, a determining step, an FPC (electric power supply member) bonding step, and a classifying step.

The flow path unit producing step includes a step of producing the flow path unit 4 shown in FIG. 5. In the flow path unit producing step, the plates 22-30, that is, the cavity plate 22, the base plate 23, the aperture plate 24, the supply plate 25, the manifold plates 26, 27 and 28, the cover plate 29 and the nozzle plate 30 are bonded by an adhesive agent while being aligned with one another so as to form the individual ink flow paths 7 internally.

The actuator unit producing step includes a step of producing the actuator units 21. In the actuator unit producing step, the plural individual electrodes 35, the piezoelectric sheet 41, the common electrode 34 and the piezoelectric sheets 42-44 are sintered in turn by baking.

The head body producing step includes a step of producing the head body 70. In the head body producing step, the flow path unit 4 produced in the flow path unit producing step and the actuator units 21 produced in the actuator unit producing step are bonded by an adhesive agent. In this event, a plurality of bonded structures are produced in the head body 70. In each of the bonded structures, a partial region of the actuator units 21 including active portions corresponding to the individual electrodes 35 respectively has been bonded with a partial region of the flow path unit 4 forming the individual ink flow paths 7 corresponding to the individual electrodes 35 respectively.

Figure 9:
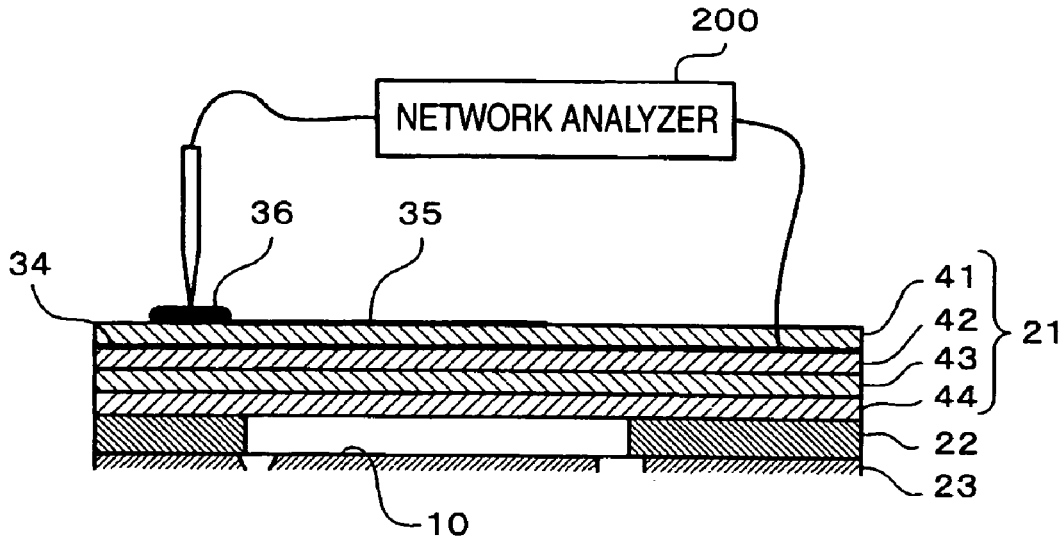
FIG. 9 is a view showing a method for measuring the frequency characteristic of impedance in a measuring step shown in FIG. 8.

The measuring step includes a step of measuring the frequency characteristic of impedance of each active portion in each bonded structure in the head body 70 produced in the head body producing step. The frequency characteristic of impedance of each active portion changes in accordance with the bonded state of the bonded structure corresponding to the active portion, as will be described later. A method for measuring the frequency characteristic of the impedance in the measuring step will be described with reference to FIG. 9. FIG. 9 is a view showing the method for measuring the frequency characteristic of impedance in an active portion. As shown in FIG. 9, a network analyzer 200 is used for measuring the frequency characteristic of impedance in each active portion. By use of a robot or the like, a probe of the network analyzer 200 is brought into contact with individual electrodes 35 corresponding to active portions to be measured, in turn, so as to measure the frequency characteristic of impedance.

Figure 10:
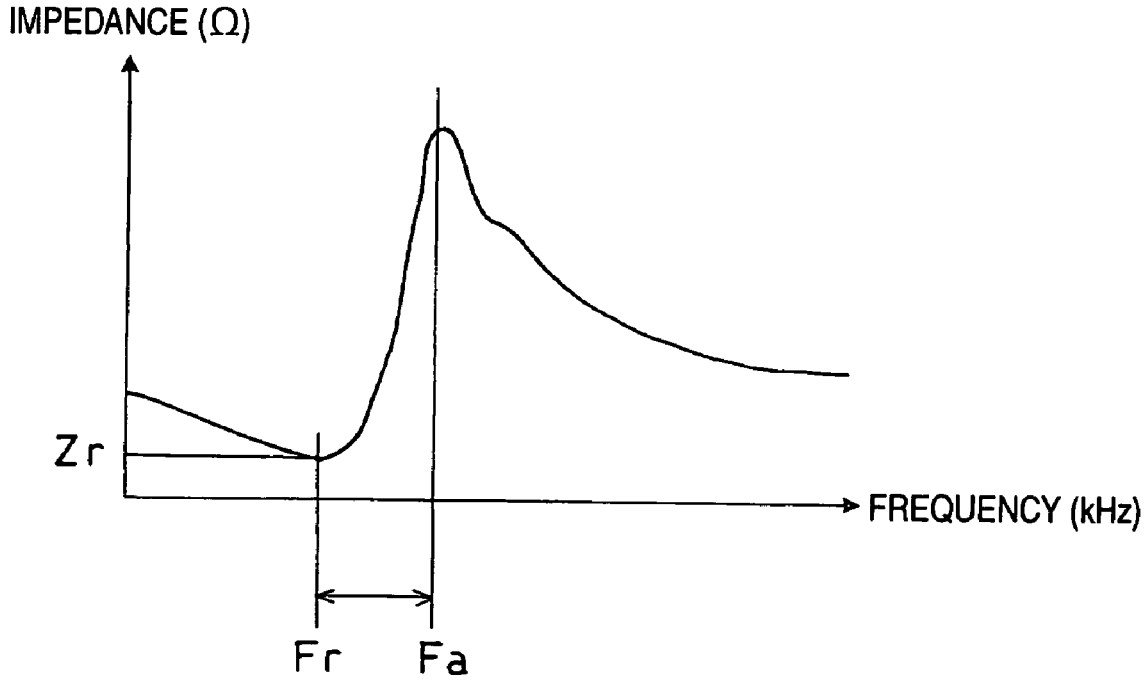
FIG. 10 is a graph showing an example of the frequency characteristic of impedance in an active portion measured in the measuring step shown in FIG. 8.

FIG. 10 shows an example of the frequency characteristic of impedance in an active portion. The ordinate designates the impedance, and the abscissa designates the frequency. As shown in FIG. 10, the frequency characteristic of impedance in the active portion has a feature that it has a resonance frequency Fr where the impedance is minimal, and an antiresonance frequency Fa where the impedance is maximal, and a feature that the antiresonance frequency Fa is higher than the resonance frequency Fr. Assume that the value of impedance at the resonance frequency Fr is a resonance impedance Zr.

The determining step includes a step of determining whether or not the head body 70 is a good product, based on the frequency characteristic of impedance in each active portion of each bonded structure measured in the measuring step. Whether or not the head body 70 is a good product is determined based on whether or not the following criteria (a)-(c) are satisfied.

Criteria (a)

(a-1) Deviations (hereinafter referred to as "Fa–Fr deviations") of differences between antiresonance frequencies Fa and resonance frequencies Fr in active portions corresponding to individual electrodes 35 are within 30% (first predetermined value) of an average value $A_{difference}$ of the difference between the antiresonance frequency Fa and the resonance frequency Fr in all the actuator units 21; and (a-2) an average value $A_{individual}$ of the Fa–Fr deviations in each of the actuator units 21 is within 15% of an average value of the average values A individual of the Fa–Fr deviations in all the actuator units 21.

The criteria (a) will be described with reference to the specific configuration of the inkjet head shown in FIG. 3. For the sake of explanation, reference numerals 21*a*, 21*b*, 21*c* and 21*d* are allotted to the actuator units 21 shown in FIG. 3. It is assumed that a difference between the antiresonance frequency Fa and the resonance frequency in each active portion is defined as $x_i$(=Fa–Fr) and that the average value of the difference values $x_i$ in all the actuator units 21 (21*a* to 21*d*) is expressed as $$\bar{x} = \left(\sum_{21a,21b,21c,21d} x_i\right).$$

Here, the Fa–Fr deviation in each active portion can be expressed as $$x_i - \bar{x} \tag{1}$$

Also, the criteria (a-1) can be expressed as $$-0.3\times\bar{x} < x_i - \bar{x} < 0.3\times\bar{x} \tag{2}$$

With reference the expression (1), the average value $A_{individual}$ of the Fa–Fr deviations in the actuator unit 21*a* can be expressed as $$\sum_{21a}\left(\frac{x_i - \bar{x}}{n}\right) \tag{3}$$

where n represents number of the active portions in the actuator unit 21*a*. Thus, the average value of $A_{individual}$ of the Fa–Fr deviations in all the actuator units 21*a* to 21*d* can be expressed as $$\frac{\sum_{21a}\left(\frac{x_i - \bar{x}}{n}\right) + \sum_{21b}\left(\frac{x_i - \bar{x}}{n}\right) + \sum_{21c}\left(\frac{x_i - \bar{x}}{n}\right) + \sum_{21d}\left(\frac{x_i - \bar{x}}{n}\right)}{4} \tag{4}$$

Accordingly, if the actuator unit 21*a* satisfies the criteria (a-2), the following expression is met.

$$0.85\times\text{expression (4)} < \sum_{21a}^{n}\left(\frac{x_a - \bar{x}}{n}\right) < 1.15\times\text{expression (4)} \tag{5}$$

Criterion (b)

(b-1) deviations (hereinafter referred to as "Fr deviations") of resonance frequencies Fr in active portions corresponding to individual electrodes 35 are within 10% (second predetermined value) of an average value $B_{Fr}$ of the resonance frequencies Fr in all the actuator units 21; and (b-2) an average value $B_{individual}$ of the Fr deviations in each of the actuator units 21 is within 5% of an average value of the average values $B_{individual}$ of the Fr deviations in all the actuator units 21.

Criterion (c)

(c-1) deviations (hereinafter referred to as "Zr deviations") of resonance impedances Zr in active portions corresponding to individual electrodes 35 are within 30% (third predetermined value) of an average value $C_{Zr}$ thereof in all the actuator units 21; and (c-2) an average value $C_{individual}$ of Zr deviations in each of the actuator units 21 is within 15% of an average value of the average values $C_{individual}$ of the Zr deviations in all the actuator units 21.

Only head bodies 70 concluded to be good products in the determining step are put forward to the next FPC bonding step.

The FPC bonding step includes a step of bonding terminals of the FPCs 50 corresponding to the individual electrodes 35 of the actuator units 21 of the head body 70 concluded to be a good-product in the determining step, by soldering.

The classifying step includes a step of grading and classifying the head body 70 having the FPCs 50 bonded in the FPC bonding step based on the measuring result obtained in the measuring step. Inkjet heads 1 into which head bodies 70 belonging to one and the same grade are incorporated should be used in one inkjet printer.

<Criteria in Determining Step>

Next, the criteria (a) to (c) in the determining step will be described in turn in detail.

(About Criteria (a))

As described above, when a voltage is applied to each active portion from its corresponding individual electrode 35, the active portion is deformed to contract in a direction perpendicular to the polarizing direction, that is, in the long-side direction of the individual electrode 35 due to piezoelectric transversal effect. In such a sheet-like piezoelectric member, the constant indicating the expansion/contraction length corresponding to a voltage applied to the piezoelectric member is expressed as a piezoelectric constant $d_{31}$ in the following expression.

$$d_{31} = k_{31}\sqrt{S_{11}^{E}\epsilon_{33}^{T}} \tag{6}$$

Here, the electromechanical coupling constant $k_{31}$ is a constant ($k_{31}<1$) indicating the efficiency with which the electric energy applied to the active portion is converted into kinetic energy in the long-side direction of the active portion. The electromechanical coupling constant $k_{31}$ shows the piezoelectric activity of the active portion. The dielectric constant $\epsilon_{33}$ is a constant indicating the easiness of polarization. The compliance S is a constant indicating the deformation ratio to stress. Thus, when the electromechanical coupling constant $k_{31}$ is grasped, it is possible to grasp the driving conditions of each active portion corresponding to each individual electrode 35, that is, the ejection conditions of ink ejected from each nozzle 8, such as its ejection velocity, its volume, etc. The electromechanical coupling constant $k_{31}$ has a relationship with the resonance frequency Fr and the antiresonance frequency Fa as shown in the following expression.

$$\frac{k_{31}^2}{1-k_{31}^2} = -\frac{\pi}{2}\cdot\frac{Fa}{Fr}\cot\left(\frac{\pi}{2}\cdot\frac{Fa}{Fr}\right) \tag{7}$$

In such a manner, in the aforementioned piezoelectric member, there is a relation as follows. That is, with the increase of the electromechanical coupling constant $k_{31}$, the ratio of the antiresonance frequency fa to the resonance frequency fr becomes larger. On the contrary, with the decrease of the electromechanical coupling constant $k_{31}$, the ratio of the antiresonance frequency fa to the resonance frequency fr becomes smaller. The fact that the ratio of the antiresonance frequency fa to the resonance frequency fr increases often results from the fact that the difference between the antiresonance frequency Fa and the resonance frequency Fr increases. Accordingly, when the difference between the antiresonance frequency Fa and the resonance frequency Fr increases, the piezoelectric constant $d_{31}$ also increases, so that the ejection velocity of ink becomes higher, and the ejected ink volume becomes larger. On the contrary, the fact that the ratio of the antiresonance frequency fa to the resonance frequency fr decreases often results from the fact that the difference between the antiresonance frequency Fa and the resonance frequency Fr decreases. When the difference between the antiresonance frequency Fa and the resonance frequency Fr decreases, the piezoelectric constant $d_{31}$ also decreases, so that the ejection velocity of ink becomes lower, and the ejected ink volume becomes smaller. In such a manner, the piezoelectric characteristic can be grasped by comparing differences between antiresonance frequencies Fa and resonance frequencies Fr among the active portions in the actuator units 21. It is therefore possible to grasp the tendency of ejection conditions of ink ejected from each nozzle 8, such as its ejection velocity, its volume, etc. Thus, it is possible to determine whether or not each bonded structure is a good product and hence whether or not the head body 70 is a good product.

As measuring results of a plurality of bonded structures, Table 1 shows an average value of ink ejection velocity, a 3σ value of the ink ejection velocity, an average value of ejected ink volume, and a 3σ value of a ration of the ejected ink volume to the average value of the ejected ink volume (that is, a 3σ value of "the ejected ink volume/the average value of the ejected ink volume") in accordance with each Fa–Fr deviation (see the criteria (a)).

TABLE 1

| fa-fr deviation | ejection velocity (m/s) | ejection velocity 3σ | droplet volume (pl) | (droplet volume/ average) 3σ |
|---|---|---|---|---|
| −40% | 8.2 | 0.52 | 5.7 | 13.3% |
| −35% | 8.3 | 0.44 | 5.8 | 11.1% |
| −30% | 8.5 | 0.31 | 6.0 | 9.4% |
| −25% | 8.7 | 0.27 | 6.1 | 8.3% |
| −20% | 8.8 | 0.25 | 6.2 | 7.2% |
| −15% | 9.0 | 0.23 | 6.3 | 6.3% |

TABLE 1-continued

| fa-fr deviation | ejection velocity (m/s) | ejection velocity 3σ | droplet volume (pl) | (droplet volume/ average) 3σ |
|---|---|---|---|---|
| −10% | 9.2 | 0.21 | 6.4 | 6.1% |
| −5% | 9.3 | 0.19 | 6.6 | 5.0% |
| 0% | 9.5 | 0.21 | 6.7 | 3.8% |
| 5% | 9.7 | 0.22 | 6.8 | 3.9% |
| 10% | 9.8 | 0.23 | 6.8 | 4.2% |
| 15% | 10.0 | 0.24 | 6.9 | 4.8% |
| 20% | 10.2 | 0.23 | 7.1 | 6.2% |
| 25% | 10.3 | 0.25 | 7.2 | 8.0% |
| 30% | 10.5 | 0.27 | 7.4 | 9.8% |
| 35% | 11.3 | 0.41 | 5.3 | 31.1% |
| 40% | 12.4 | 0.5 | 5.1 | 45.3% |

Figure 11:
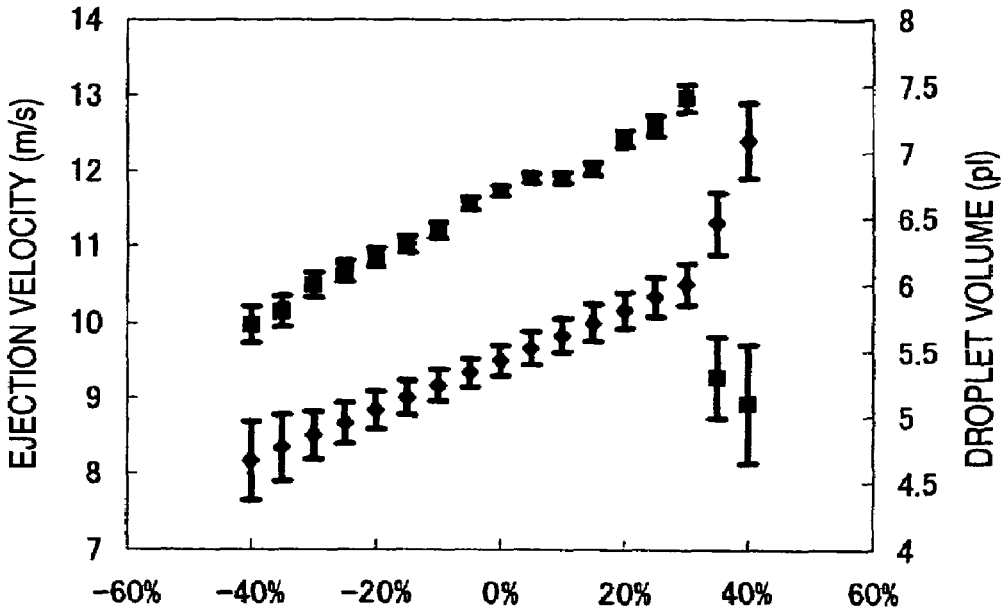
FIG. 11 is a graph showing a relationship among the Fa−Fr deviations of active portions of each bonded structure, the ink ejection velocity and the ink volume in the actuator unit depicted in FIG. 5.

The head body 70 is concluded to be better in ejection condition as the head body 70 has a narrower variation in the ink ejection velocity and the ink droplet volume. Here, the variation of the ink ejection velocity is determined based on comparison of the 3σ value of the ink ejection velocity. However, as for the ink volume, with increase of the volume, the volume of small ink droplets generated with an ink droplet when the ink drop is ejected increases so that the absolute volume of the variation of the ink volume also increases. In consideration of this fact, the variation of the ink volume is determined based on comparison of the 3σ value of the ratio of the ejected ink volume to the average value thereof. Further, FIG. 11 shows the measuring results. The abscissa designates the Fa–Fr deviation (%). It is noted that the Fa–Fr deviation (%) is expressed by the following expression.

$$Fa-Fr\,\text{deviation}\ (\%) = \frac{Fa-Fr\,\text{deviation}}{\text{average value of }(Fa-Fr)}\times 100$$

The ordinate on the left side designates the ink ejection velocity (m/sec), and the ordinate on the right side designates the ejected ink volume (pl). Each diamond sign in FIG. 11 designates an average value of ink ejection velocities from the nozzles 8 corresponding to the active portions classified for each deviation. Each square sign in FIG. 11 designates an average value of ink volumes ejected from the nozzles 8 corresponding to the active portions classified for each deviation. The variation of the ink ejection velocities is shown by the range of ±3σ, and the variation of the ink volumes is shown by 3σ values of the ratio (%) of the ejected ink volume to the average value thereof. As shown in FIG. 11, also in each actuator unit 21, with increase of the Fa–Fr deviation, which is a deviation of the difference between the antiresonance frequency Fa and the resonance frequency Fr, the ink ejection velocity becomes higher, and the ejected ink volume becomes larger. On the contrary, with decrease of the Fa–Fr deviation, the ink ejection velocity becomes lower, and the ejected ink volume becomes smaller. Here, when the Fa–Fr deviation (%) increases by 35% or more in the positive direction, the ink ejection velocity increases suddenly, while the ejected ink volume decreases suddenly, and the variation thereof is widened. This is because the pressure to eject ink becomes so high that an ejected ink droplet is split. On the contrary, when the Fa–Fr deviation (%) increases by 35% or more in the negative direction, the variation of the ejection velocity and that of the ejected ink volume increase suddenly.

Therefore, any head body 70 whose Fa–Fr deviation (%) is out of the range of from −30% to 30% in any active portion is concluded to be defective. When a plurality of actuator units 21 are bonded to the head body 70, it is desired that the ejection characteristics of the actuator units 21 are equalized with each other. To this end, in addition to the aforementioned criterion, it is preferable that an average value of Fa–Fr deviations in each of the actuator units 21 is set within 15% of an average value of the average values of Fa–Fr deviations in all the actuator units 21.

Further, the ink ejection velocity and the ejected ink volume are stable when the range of Fa–Fr deviations (%) is within 20%. Accordingly, when there is a request for a higher-quality head body 70, it is preferable that any head body 70 whose Fa–Fr deviation (%) is out of the range of from −20% to 20% in any active portion is concluded to be defective. When a plurality of actuator units 21 are bonded to the head body 70, it is desired that the ejection characteristics of the actuator units 21 are equalized with each other. To this end, in addition to the aforementioned criterion, it is preferable that an average value of Fa–Fr deviations in each of the actuator units 21 is set within 10% of an average value of the average values of Fa–Fr deviations in all the actuator units 21.

In addition, the ink ejection velocity and the ink volume are more stable when the range of Fa–Fr deviations (%) is within 10%. Accordingly, when there is a request for a higher-quality head body 70, it is preferable that any head body 70 whose Fa–Fr deviation (%) is out of the range of from −10% to 10% in any active portion is concluded to be defective. When a plurality of actuator units 21 are bonded to the head body 70, it is desired that the ejection characteristics of the actuator units 21 are equalized with each other. To this end, in addition to the aforementioned criterion, it is preferable that an average value of Fa–Fr deviations in each of the actuator units 21 is set within 5% of an average value of the average values of Fa–Fr deviations in all the actuator units 21.

(About Criteria (b))

The resonance frequency Fr in an active portion is influenced by the constrained state of the active portion, that is, the bonded state between respective layers in each bonded structure, the bonded state between respective plates in the flow path unit 4, and the bonded state between each bonded structure and the flow path unit 4. When the constrained state of an active portion is strong, the resonance frequency Fr of the active portion becomes high. In this case, there is a tendency that the velocity of ejected ink decreases and the volume of the ink decreases. This is because the lamination-direction thickness is increased in each bonded state. On the contrary, when the constrained state of an active portion is weak, the resonance frequency Fr of the active portion becomes low. In this case, there is a tendency that the velocity of ejected ink increases and the ejected ink volume increases. This is because the lamination-direction thickness is reduced in each bonded state. In such a manner, when the resonance frequencies Fr of active portions are compared with each other, it is possible to determine the bonded state between members taking part in each active portion. Thus, it is possible to determine whether or not each bonded structure is a good product and hence whether or not the head body 70 is a good product.

As measuring results of a plurality of bonded structures, Table 2 shows an average value of ink ejection velocity, a 3σ value of the ink ejection velocity, an average value of ejected ink volume, and a 3σ value of a ratio of the ejected ink volume to the average value of the ejected ink volume in accordance with each Fr deviation (see the criteria (b)).

TABLE 2

| Fr deviation | ejection velocity (m/s) | ejection velocity 3σ | droplet volume (pl) | (droplet volume/average) 3σ |
|---|---|---|---|---|
| −15% | 7.8 | 1.17 | 4.5 | 15.0% |
| −12% | 10.8 | 0.92 | 7.7 | 11.2% |
| −10% | 10.3 | 0.34 | 7.4 | 9.5% |
| −8% | 10 | 0.27 | 7.2 | 8.3% |
| −6% | 9.8 | 0.25 | 7 | 7.2% |
| −3% | 9.6 | 0.24 | 6.8 | 6.0% |
| 0% | 9.5 | 0.22 | 6.7 | 3.8% |
| 3% | 9.4 | 0.23 | 6.6 | 4.8% |
| 6% | 9.2 | 0.25 | 6.5 | 7.6% |
| 8% | 9.1 | 0.26 | 6.4 | 8.9% |
| 10% | 8.8 | 0.28 | 6.2 | 9.9% |
| 12% | 8.3 | 0.40 | 5.7 | 19.0% |
| 15% | 7.1 | 0.78 | 3.8 | 42.0% |

Figure 12:
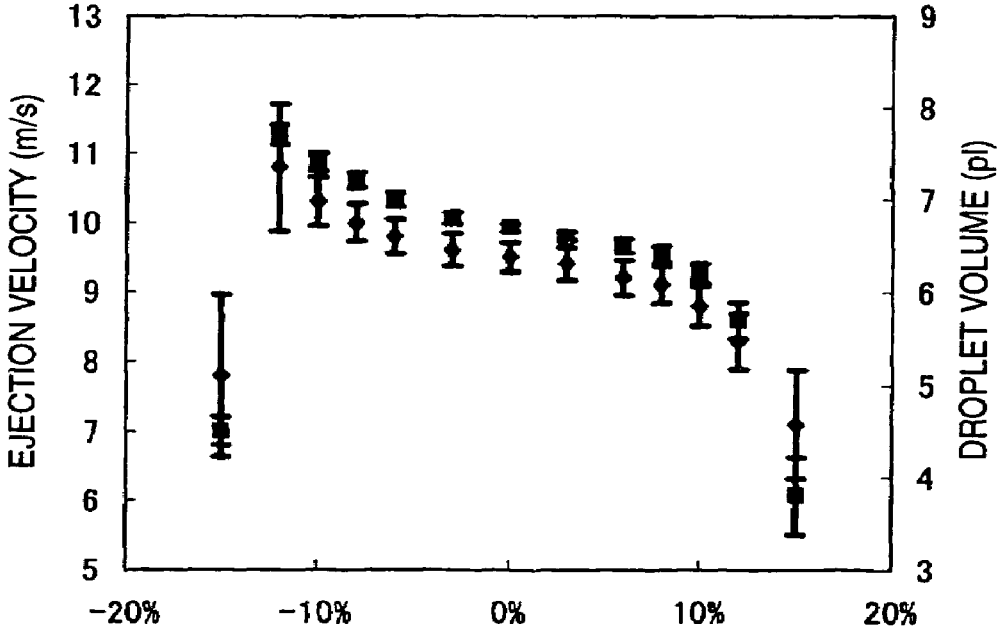
FIG. 12 is a graph showing a relationship among the Fr deviations of active portions of each bonded structure, the ink ejection velocity and the ink volume in the actuator unit depicted in FIG. 5.

Further, FIG. 12 shows the measuring results. The abscissa designates the Fr deviation (%). It is noted that Fr deviation (%) is expressed by the following expression.

$$Fr\,\text{deviation}\ (\%) = \frac{Fr\,\text{deviation}}{\text{average value of } Fr} \times 100$$

The ordinate on the left side designates the ink ejection velocity (m/sec), and the ordinate on the right side designates the ejected ink volume (pl). Each diamond sign in FIG. 12 designates an average value of ink ejection velocities from the nozzles 8 corresponding to the active portions classified for each deviation. Each square sign in FIG. 12 designates an average value of ink volumes ejected from the nozzles 8 corresponding to the active portions classified for each deviation. The variation of the ink ejection velocities is shown by the range of ±3σ, and the variation of the ink volumes is shown by 3σ values of the ratio (%) of the ejected ink volume to the average value thereof. As shown in FIG. 12, also in the actuator unit 21, with increase of the Fr deviation, which is a deviation of the resonance frequency Fr, the ink ejection velocity becomes lower, and the ejected ink volume becomes smaller. On the contrary, with decrease of the Fr deviation, the ink ejection velocity becomes higher, and the ejected ink volume becomes larger. When the Fr deviation (%) increases by 12% or more in the positive direction, the ink ejection velocity decreases suddenly while the ejected ink volume decreases suddenly, and the variation thereof is widened. This is because the lamination-direction thickness in each bonded state is partially increased extremely due to overfilling with an adhesive agent. On the contrary, when the Fr deviation (%) increases by 12% or more in the negative direction, the variations of the ejection velocity and the ejected ink volume increase. Particularly when the Fr deviation (%) increases by 12% or more in the negative direction, the ink ejection velocity becomes lower, and the ejected ink volume also becomes smaller. This is because there is a failure in at least one of the bonded states.

Therefore, any head body 70 whose Fr deviation (%) is out of the range of from −10% to 10% in any active portion is concluded to be defective. When a plurality of actuator units 21 are bonded to the head body 70, it is desired that the ejection characteristics of the actuator units 21 are equalized with each other. To this end, in addition to the aforementioned criterion, it is preferable that an average value of Fr deviations in each of the actuator units 21 is set within 5% of an average value of the average values of Fr deviations in all the actuator units 21.

Further, the ink ejection velocity and the ejected ink volume are stable when the range of Fr deviations (%) is within 6%. Accordingly, when there is a request for a higher-quality head body 70, it is preferable that any head body 70 whose Fr deviation (%) is out of the range of from −6% to 6% in any active portion is concluded to be defective. When a plurality of actuator units 21 are bonded to the head body 70, it is desired that the ejection characteristics of the actuator units 21 are equalized with each other. To this end, in addition to the aforementioned criterion, it is preferable that an average value of Fr deviations in each of the actuator units 21 is set within 3% of an average value of the average values of Fr deviations in all the actuator units 21.

In addition, the ink ejection velocity and the ejected ink volume are more stable when the range of Fr deviations (%) is within 3%. Accordingly, when there is a request for a higher-quality head body 70, it is preferable that any head body 70 whose Fr deviation (%) is out of the range of from −3% to 3% in any active portion is concluded to be defective. When a plurality of actuator units 21 are bonded to the head body 70, it is desired that the ejection characteristics of the actuator units 21 are equalized with each other. To this end, in addition to the aforementioned criterion, it is preferable that an average value of Fr deviations in each of the actuator units 21 is set within 1.5% of an average value of the average values of Fr deviations in all the actuator units 21.

(About Criteria (c))

The resonance impedance Zr in an active portion is influenced by the polarizability of the active portion. When the polarizability of an active portion is low, the resonance impedance Zr of the active portion becomes high. In this case, there is a tendency that the velocity of ejected ink decreases and the ejected ink volume decreases. On the contrary, when the polarizability of an active portion is high, the resonance impedance Zr of the active portion becomes low. In this case, there is a tendency that the velocity of ejected ink increases and the ejected ink volume increases. In such a manner, when the resonance impedances Zr of the active portions are compared with one another, it is possible to determine the uniformity of the material characteristic in the piezoelectric sheet 41.

As measuring results of a plurality of bonded structures, Table 3 shows an average value of ink ejection velocity, a 3σ value of the ink ejection velocity, an average value of ejected ink volume, and a 3σ value of a ratio of the ejected ink volume to the average value of the ejected ink volume in accordance with each Zr deviation (see the criteria (c)).

TABLE 3

| Zr deviation | ejection velocity (m/s) | ejection velocity 3σ | droplet volume (pl) | (droplet volume/average) 3σ |
|---|---|---|---|---|
| −40% | 12.6 | 0.53 | 4.8 | 39.1% |
| −35% | 11.1 | 0.41 | 5.7 | 32.4% |
| −30% | 10.4 | 0.32 | 7.2 | 9.8% |
| −25% | 10.1 | 0.31 | 7 | 8.4% |
| −20% | 9.9 | 0.29 | 6.9 | 7.9% |
| −10% | 9.6 | 0.24 | 6.8 | 6.7% |
| 0% | 9.5 | 0.22 | 6.7 | 3.8% |
| 10% | 9.4 | 0.25 | 6.6 | 4.0% |

TABLE 3-continued

| Zr deviation | ejection velocity (m/s) | ejection velocity 3σ | droplet volume (pl) | (droplet volume/average) 3σ |
|---|---|---|---|---|
| 20% | 9 | 0.27 | 6.4 | 6.8% |
| 25% | 8.7 | 0.30 | 6.3 | 8.0% |
| 30% | 8.3 | 0.34 | 6.2 | 9.7% |
| 35% | 8.1 | 0.57 | 5.6 | 11.0% |
| 40% | 7.2 | 1.10 | 5 | 14.8% |

Figure 13:
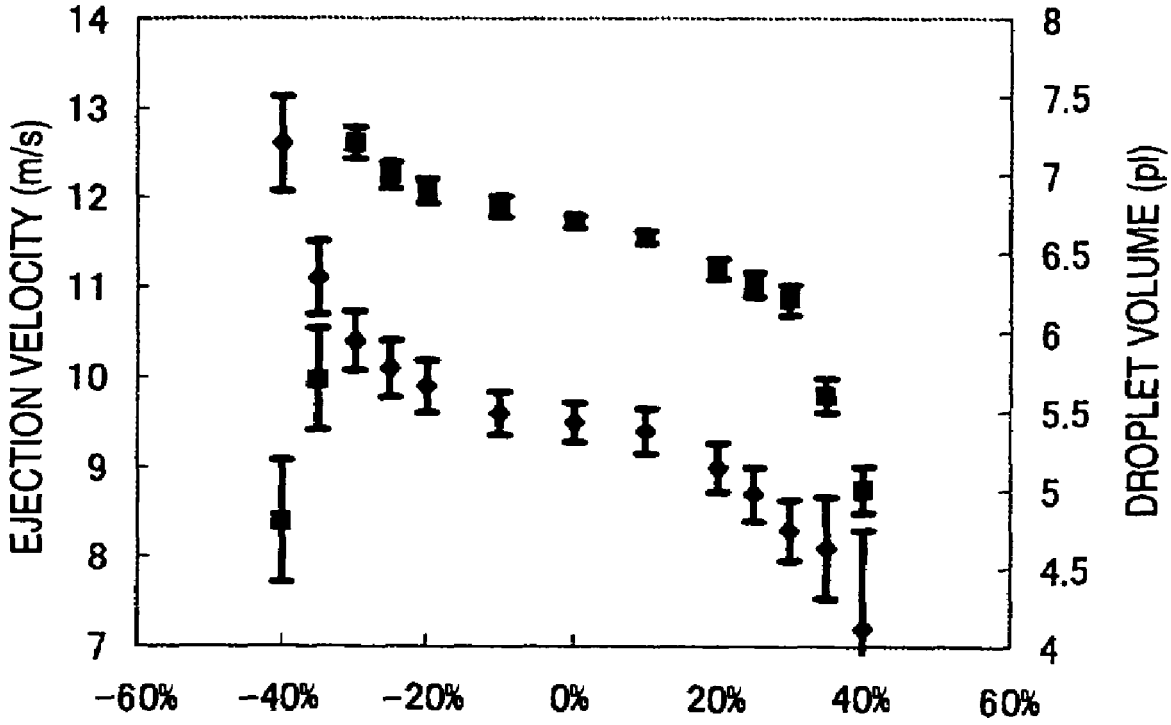
FIG. 13 is a graph showing a relationship among the Zr deviations of active portions of each bonded structure, the ink ejection velocity and the ink volume in the actuator unit depicted in FIG. 5.

Further, FIG. 13 shows the measuring results. The abscissa designates the Zr deviation (%). It is noted tat the Zr deviation (%) is expressed by the following expression.

$$Zr\ \text{deviation}\ (\%) = \frac{Zr\ \text{deviation}}{\text{average value of}\ Zr} \times 100$$

The ordinate on the left side designates the ink ejection velocity (m/sec), and the ordinate on the right side designates the ejected ink volume (pl). Each diamond sign in FIG. 13 designates an average value of ink ejection velocities from the nozzles 8 corresponding to the active portions classified for each deviation. Each square sign in FIG. 13 designates an average value of ink volumes ejected from the nozzles 8 corresponding to the active portions classified for each deviation. The variation of the ink ejection velocities is shown by the range of ±3σ, and the variation of the ink volumes is shown by 3σ values of the ejected ink volume to the average value thereof. As shown in FIG. 13, also in the actuator unit 21, with increase of the Zr deviation, which is a deviation of the resonance impedance Zr, there is a tendency that the ink ejection velocity decreases and the ejected ink volume decreases. On the contrary, with decrease of the Zr deviation, there is a tendency that the ink ejection velocity increases and the ejected ink volume increases. When the Zr deviation (%) increases by 35% or more in the positive direction, the ink ejection velocity decreases suddenly while the ejected ink volume decreases suddenly, and the variation thereof is widened. On the contrary, when the Zr deviation (%) increases by 35% or more in the negative direction, the ink ejection velocity increases suddenly while the ejected ink volume decrease suddenly, and the variation thereof is widened. This is because the pressure to eject ink becomes so high that the ejected ink is split.

Therefore, any head body 70 whose Zr deviation (%) is out of the range of from −30% to 30% in any active portion is concluded to be defective. When a plurality of actuator units 21 are bonded to the head body 70, it is desired that the ejection characteristics of the actuator units 21 are equalized with each other. To this end, in addition to the aforementioned criterion, it is preferable that an average value of Zr deviations in each of the actuator units 21 is set within 15% of an average value of the average values of Zr deviations in all the actuator units 21.

Further, the ink ejection velocity and the ink volume are stable when the range of Zr deviations (%) is within 20%. Accordingly, when there is a request for a higher-quality head body 70, it is preferable that any head body 70 whose Zr deviation (%) is out of the range of from −20% to 20% in any active portion is concluded to be defective. When a plurality of actuator units 21 are bonded to the head body 70, it is desired that the ejection characteristics of the actuator units 21 are equalized with each other. To this end, in addition to the aforementioned criterion, it is preferable that an average value of Zr deviations in each of the actuator units 21 is set within 10% of an average value of the average values of Zr deviations in all the actuator units 21.

In addition, the ink ejection velocity and the ink volume are more stable when the range of Zr deviations (%) is within 10%. Accordingly, when there is a request for a higher-quality head body 70, it is preferable that any head body 70 whose Zr deviation (%) is out of the range of from −10% to 10% in any active portion is concluded to be defective. When a plurality of actuator units 21 are bonded to the head body 70, it is desired that the ejection characteristics of the actuator units 21 are equalized with each other. To this end, in addition to the aforementioned criterion, it is preferable that an average value of Zr deviations in each of the actuator units 21 is set within 5% of an average value of the average values of Zr deviations in all the actuator units 21.

In the preferred embodiment described above, only head bodies 70 whose Fa−Fr deviations, Fr deviations and Zr deviations are within non-defective ranges respectively are concluded to be good products in the determining step. Accordingly, a failure in bonding between members and a failure in the actuator unit 21 can be determined accurately. As a result, it is possible to save a useless cost of parts and a useless manufacturing cost for defective head bodies 70.

In addition, the determining step is carried out in the state where no FPC 50 is bonded. Accordingly, whether or not each bonded structure in the head body 70 is a good product can be determined accurately without any influence from the resistance of the FPC 50 itself, stray capacitance or the like. It is therefore possible to save a useless cost of parts and a useless manufacturing cost. In addition, the FPC 50 is bonded only to the head body 70 having bonded structures all of which have been concluded to be good products in the determining step. Accordingly, there is no fear that the FPC 50 is wasted due to a failure in the head body 70.

Further, in this embodiment, head bodies 70 concluded to be good products in the determining step are graded in accordance with their ejection characteristics. Accordingly, the ejection characteristics can be equalized among a plurality of head bodies 70.

In addition, in this embodiment, the frequency characteristic of impedance in each active portion is measured by the network analyzer 200. Accordingly, measuring can be performed more rapidly than measuring by use of an impedance analyzer.

This embodiment has a configuration in which only when a head body 70 satisfies all the criteria (a) to (c) in the determining step, the head body 70 is concluded to be a good product. However, the invention is not limited to such a configuration. A head body 70 may be concluded to be a good product when it satisfies one or two of the criteria (a) to (c), that is, it satisfies only the criteria (a), only the criteria (b), only the criteria (c), the criteria (a) and (b), the criteria (a) and (c), or the criteria (b) and (c). In this case, whether or not the head body 70 is a good product can be determined more rapidly than when all the criteria (a) to (c) are checked.

In addition, this embodiment has a configuration in which the frequency characteristic of impedance in each active portion is measured by the network analyzer 200. However, the invention is not limited to such a configuration. The frequency characteristic may be measured by an impedance analyzer. In this case, measuring results can be obtained more accurately than measuring by the network analyzer 200.

Further, this embodiment has a configuration in which the measuring step and the determining step are carried out in the state where the FPC 50 is not bonded. The invention is not limited to such a configuration. The measuring step and the determining step may be carried out after the step of bonding the FPC 50. For example, after the step of bonding the FPC 50, the Fa−Fr deviation may be measured to carry out determination based on the criteria (a). Alternatively, after the FPC 50 is bonded, the measuring step may be performed to carry out determination including at least the criteria (a). Even after the bonding of the FPC 50, there is no change in the correlation between the difference Fa−Fr and the ejection characteristic of the inkjet head, which correlation was discovered by the present inventors. Thus, whether or not the inkjet head is a good product can be determined satisfactorily.

Although the preferred embodiment of the invention has been described above, the invention is not limited to the aforementioned embodiment. Various changes on design can be made on the invention without departing from the scope stated in the claims. For example, this embodiment has a configuration in which whether or not the head body 70 is a good product is determined by given criteria set for the resonance frequency Fr, the antiresonance frequency Fa and the resonance impedance Zr. However, the invention is not limited to such a configuration. Whether or not the head body 70 is a good product may be determined directly from a waveform pattern of the frequency characteristic of impedance in each active portion.

What is claimed is:

1. A method for manufacturing an inkjet head, comprising:

producing a flow path unit that comprises a plurality of individual ink flow paths passing through pressure chambers and reaching nozzles for ejecting ink, respectively;

producing an actuator unit that comprises a piezoelectric structure;

bonding the actuator unit with the flow path unit to produce a bonded structure of the flow path unit and the actuator unit;

measuring a frequency characteristic of impedance of the piezoelectric structure of the bonded structure in each of plural regions facing at least one of the pressure chambers; and determining whether or not the bonded structure is a good product on a basis of at least one of:

(a) a distribution of (Fa−Fr) in the plural regions where Fa represents antiresonance frequency of each region at which impedance of each region are maximal and Fr represents resonance frequency of each region at which impedance of each region is minimal;

(b) a distribution of Fr in the plural regions; and (c) a distribution of Zr in the plural regions, where Zr represents impedance of each region at the resonance frequency of each region.

2. The method according to claim 1, further comprising: bonding an electric power supply member that supplies a driving signal to the actuator unit, the actuator unit of the bonded structure being concluded to be the good product in the determining.

3. The method according to claim 1, wherein the bonded structure is concluded to be the good product in the determining, when all deviations of (Fa −Fr) each corresponding to the plural regions are within a predetermined range.

4. The method according to claim 3, wherein the bonded structure is concluded to be the good product in the determining, when all the deviations of (Fa−Fr) is larger than 70% of an average of (Fa−Fr) in all the regions and is smaller than 130% of the average of (Fa−Fr) in all the regions.

5. The method according to claim 1, wherein:

the bonding comprises bonding a plurality of actuator units with the flow path unit; and the bonded structure is concluded to be the good product in the determining, when (x) all deviations of (Fa−Fr) each corresponding to the regions of the actuator units are within a predetermined range, and (y) an average value of the deviations of (Fa−Fr) in each actuator unit is within another predetermined range set for the bonded structure.

6. The method according to claim 1, wherein the determining comprises determining whether or not the bonded structure is the good product on a basis of (a) the distribution of (Fa−Fr) in the plural regions and (b) the distribution of Fr in the plural regions.

7. The method according to claim 6, wherein the bonded structure is concluded to be the good product in the determining, when (p)−α<all deviations of (Fa−Fr) each corresponding to the plural regions of the bonded structure <α and (q)−β<all deviations of Fr each corresponding to the plural regions of the bonded structure <β are satisfied, where a is a first predetermined value and β is a second predetermined value.

8. The method according to claim 1, wherein the determining comprises determining whether or not the bonded structure is the good product on a basis of (a) the distribution of (Fa−Fr) in the plural regions, (b) the distribution of Fr in the plural regions, and (c) the distribution of Zr in the plural regions.

9. The method according to claim 8, wherein the bonded structure is concluded to be the good product in the determining, when (p)−β<all deviations of (Fa−Fr) each corresponding to the plural regions of the bonded structure <β; (q)−β<all deviations of Fr each corresponding to the plural regions of the bonded structure <βare satisfied; and (r)−γ<all deviations of Zr each corresponding to the plural regions of the bonded structure <γ, where β is a first predetermined value, β is a second predetermined value, and γ is a third predetermined value.

10. The method according to claim 1, wherein:

the bonding comprises bonding a plurality of actuator units with the flow path unit; and the bonded structure is concluded to be the good product in the determining, when (p')−β<all deviations of(Fa−Fr) each corresponding to the plural regions of the bonded structure <βand −δ<an average value of the deviations of (Fa−Fr) in each actuator unit <δ;(q')−β<all deviations of Fr each corresponding to the plural regions of the bonded structure <βare satisfied and −∈<an average value of the deviations of Fr in each actuator unit <∈; or (r')−γ<all deviations of Zr each corresponding to the plural regions of the bonded structure <γand −ζ<an average value of the deviations of Zr in each actuator unit <ζ, where β is a first predetermined value, βis a second predetermined value, γ is a third predetermined value, δ is a fourth predetermined value set for the bonded structure, ∈ is a fifth predetermined value set for the bonded structure, and ζ is a sixth predetermined value set for the bonded structure.

11. The method according to claim 1, further comprising:

classifying the bonded structure concluded to be the good product in the determining, into one of plural classes on a basis of a measuring result obtained in the measuring.

12. The method according to claim 1, wherein the measuring uses a network analyzer.

13. A method for manufacturing an inkjet head, comprising:

producing a flow path unit that comprises a plurality of individual ink flow path passing through pressure chambers and reaching nozzles for ejecting ink, respectively;

producing an actuator unit that comprises a piezoelectric structure;

bonding the actuator unit with the flow path unit to produce a bonded structure of the flow path unit and the actuator unit;

measuring a frequency characteristic of impedance of the piezoelectric structure of the bonded structure in each of plural regions facing at least one of the pressure chambers;

determining whether or not the bonded structure is a good product on a basis of a distribution of (Fa−Fr) in the plural regions where Fa represents antiresonance frequency of each region at which impedance of each region are maximal and Fr represents resonance frequency of each region at which impedance of each region is minimal; and bonding an electric power supply member that supplies a driving signal to the actuator unit, the actuator unit of the bonded structure being concluded to be the good product in the determining, wherein the electric power supply member is not bonded to the actuator unit of the bonded structure concluded to be a defective product in the determining.

* * * * *